United States Patent [19]

Lopez

[11] 4,129,669

[45] Dec. 12, 1978

[54] METHOD OF APPLYING DECORATIVE DESIGNS TO SURFACES

[76] Inventor: Martha Z. Lopez, 224 Holly Ave., South San Francisco, Calif. 94080

[21] Appl. No.: 737,482

[22] Filed: Nov. 1, 1976

[51] Int. Cl.[2] ..... B05D 1/32; B41N 1/24

[52] U.S. Cl. ..... 427/282; 101/128.2; 101/129; 156/253; 428/61; 428/354

[58] Field of Search ..... 427/282, 272; 101/128.2; 118/505; 428/44, 61, 40, 354; 156/264, 266

[56] References Cited

U.S. PATENT DOCUMENTS

| | | | |
|---|---|---|---|
| 164,507 | 6/1875 | Alexander et al. | 428/61 X |
| 2,025,457 | 12/1935 | Kavanaugh | 101/128.2 |
| 2,175,364 | 10/1939 | Rugenstein | 101/128.2 |
| 3,027,337 | 3/1962 | Tritsch | 428/354 |
| 3,712,825 | 1/1973 | Yocum | 427/282 X |
| 3,929,068 | 12/1975 | Budden | 101/128.2 |

*Primary Examiner*—Ronald H. Smith
*Assistant Examiner*—Evan K. Lawrence
*Attorney, Agent, or Firm*—Robert Charles Hill

[57] ABSTRACT

A method of applying decorative designs through a stencil to surfaces comprises applying an adhesive stencil to a surface and painting the stencil to form a decorative design on the surface. The stencil may be made from a laminated sheet consisting of two layers of waterproof adhesive tapes, each layer containing a plurality of adjacent tapes and the second layer covering the seams in the first layer to form the laminate.

1 Claim, 6 Drawing Figures

METHOD OF APPLYING DECORATIVE DESIGNS TO SURFACES

BACKGROUND OF THE INVENTION

1. Field of The Invention

The present invention relates to a method of applying decorative designs to surfaces such as interior and exterior walls, ceilings, furniture and miscellaneous other domestic objects.

2. Description of The Prior Art

Home decorating continues to have widespread acceptance as an enjoyable form of recreation, as a way of saving money in home improvements and as a way to make an abode a more beautiful place in which to live. People decorating their homes or rooms range in age from children in grade school to the elderly. Room walls and ceilings are a favorite area to decorate with posters, hangings and decorative designs by means of a stencil. Curiously enough, there is no known commercially available stencil suitable for use on a large surface as a wall or ceiling.

Careful analysis of the problems encountered with the existing prior art stencils led to the conclusion that the ideal wall or ceiling stencil should be of one piece construction, should adhere totally to the surface to be decorated, and should be reuseable. Unfortunately, as will be seen below, none of the prior art devices possesses all of these desired attributes.

U.S. Pat. No. 2,651,871 shows a stencil held in place with masking tape or by hand. This device obviously could not be used to decorate the entire length of a wall or ceiling at one time.

U.S. Pat. No. 3,665,889 uses a series of stencils in sequence to produce a composite display. Each stencil has registration guide means and registration indicator means as well as a protective covering sheet of readily peelable material. Likewise, this complicated structure is not suitable for the use intended by applicant.

SUMMARY OF THE INVENTION

It is the primary object of the present invention to provide a new and improved method of applying decorative designs to surfaces using a stencil which is inexpensive to manufacture and long lasting in usage.

The method of the invention comprises providing a stencil such as by forming a laminated sheet from two layers of waterproof adhesive tapes, each layer containing a plurality of adjacent tapes, and cutting a decorative design out of the sheet to form the stencil; applying the adhesive surface of the stencil to a surface to be decorated; painting the stencil including the decorative cut out portion; and removing the stencil from the surface leaving the decorative design painted thereon. The stencil is reusable because of the waterproof front surface and adhesive rear surface.

DESCRIPTION OF THE PREFERRED EMBODIMENTS

Figure 1:
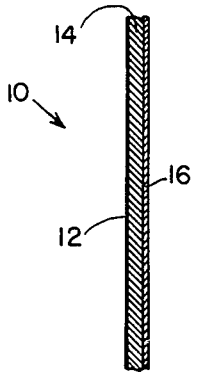
FIG. 1 is an enlarged side sectional view of a stencil constructed in accordance with the present invention.

Referring to FIG. 1 which illustrates a stencil to be used in the method of the present invention, the flexible stencil generally indicated 10 has a smooth waterproof surface 12, a strong backing 14 and an adhesive mass rear surface 16. The backing 14 can be cloth or some similar other material. To ensure airtight seams at overlaps, as will be later described, a polyethylene film or the like may be laminated to the backing 14. The adhesive mass rear surface can be a rubber-resin base or some similar other material which will not damage the surface to which it is adhered and which retains adequate adhesiveness over long usage.

Figure 6:
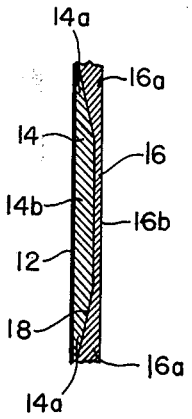
FIG. 6 is an enlarged side sectional view similar to FIG. 1 with the adhesive mass thicker at the outside than in the middle.

Since it is especially important that the stencil 10 adhere to a surface at the edges or borders, a variation of the invention is shown in FIG. 6 wherein the adhesive mass rear surface 16 is thicker at the outside **16*a* than in the middle 16*b*. Likewise, the backing 14 is thinner at the outside 14*a* than in the middle 14*b*. This is accomplished by slanted facing 18 which decreases the thickness of the backing 14 and increases the thickness of rear surface 16 while maintaining a constant overall thickness of the stencil 10**. In this form at least 25% of the adhesive mass should be of increased thickness.

The overall thickness of the stencil 10 should be from 10 to 30 mils with a thickness of 12 to 14 mils very desirable. So the stencil 10 will not accidentally be torn during usage, a bursting strength of at least 60 p.s.i. is suitable with a strength of 75 p.s.i. very desirable. The waterproof surface 12 should have a water penetration rate of not more than 2.0 grams per 24 hours per 100 inches of stencil. In addition the water vapor transmission rate should not exceed 1 gram per 24 hours.

Figure 5:
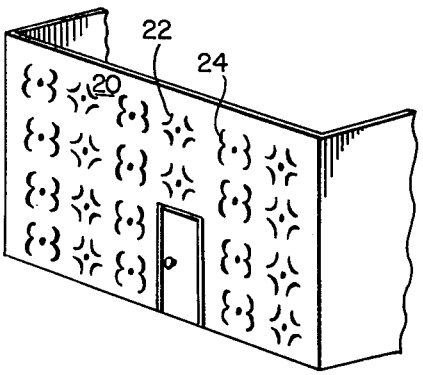
FIG. 5 illustrates a wall having decorative designs thereon.

The stencil 10 can be manufactured in various widths in a roll form of any desired length with the decorative designs cut into the stencil during production. The stencil 10 would merely be unrolled directly onto the surface such as a wall 20 (FIG. 5) and cut off at the desired length. Paint would then be applied in a conventional way such as by brush, roller or a spray gun. After drying the stencil would be removed from the wall 20 leaving the perfecly painted decorative designs 22 and 24 thereon.

In this manner, it is possible to decorate walls and ceilings in any direction as well as objects of a curved nature such as furniture, plates and adornments, etc., constructed of any material such as wood, leather, plastic, porcelain, glass, marble, etc., employing for each object and material the proper type and base of paint. The system may also include the execution of letters, words, complete sentences, numbers and figures of extensive proportions such as persons, animals, flowers, etc., either in silhouette or with visible features appropriate for murals and commercial art, etc. The effect of these designs is to transform a simple or average room into a very beautiful one.

The use of discretion and good taste in the selection of designs and colors will allow walls to be covered fringes of a horizontal or vertical shape or with isolated designs located artistically in appropriate places of display to obtain a pleasant feeling such as around the doors or windows and/or by drawing fringes on parts of the ceiling. Also isolated large or small designs can be placed at the center or around the edges of walls and around frames of pictures and mirrors. The designs can be registered in catalogues by number and series according to model, size and use.

While all of the above stencils had a decorative design placed into them during manufacture, it should be understood that the stencil 10 can be produced without a design so that individuals can cut out their own decorations. If the width of smooth waterproof adhesive tape is smaller than the width of the desired stencil, this invention also includes a method of applying decorative designs to surfaces using the stencil which is disclosed in FIGS. 2 through 4.

Figure 2:
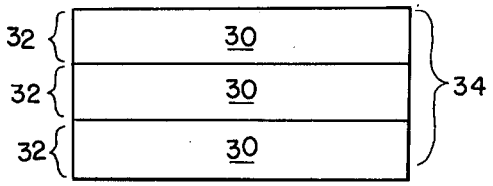
FIG. 2 is a top plan view illustrating a plurality of adhesive tapes adjacent each other.
Figure 3:
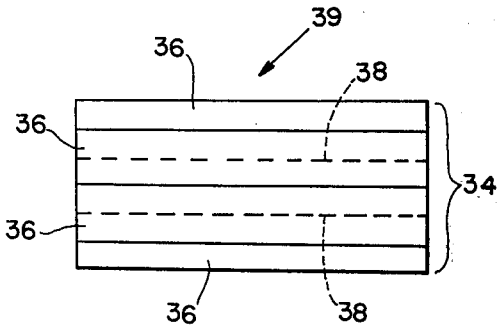
FIG. 3 is a top plan view illustrating a second layer of tapes in overlapping relationship thereto to form a laminated sheet.
Figure 4:
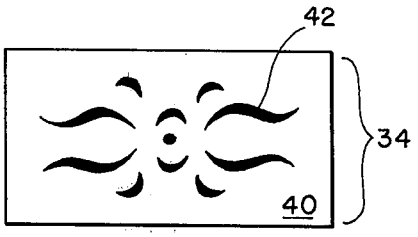
FIG. 4 is a top plan view showing the stencil with a decorative design therein formed from the laminated sheet.

Referring to FIG. 2, there is shown a plurality of adhesive tapes 30 such as described above longitudinally adjacent each other, each having a width 32 and forming a first layer having a desired width 34. In FIG. 3, there is shown a plurality of tapes 36 forming a second layer in overlapping relationship to the tapes 30, numeral 38 indicating the seams in the first layer. Both layers form a laminated sheet generally indicated 39 from which a decorative design 42 can be cut to form the stencil 40 as shown in FIG. 4 If each tape is 14 mil in thickness, the stencil would be 28 mil in thickness. Certain portions of tapes 36 can be cut off to maintain the desired width 34 of the stencil. The canvas 40 has a waterproof non-adhesive front surface and an adhesive rear surface since the rear surfaces of tapes 36 are placed on top of the front surfaces of tapes 30.

The stencil 40 is then applied to the surface to be decorated, paint is applied to stencil 40 including the decorative design portion and after the paint has dried the canvas is removed from the surface leaving the decorative design painted thereon.

It will be obvious that numerous modifications and variations are possible for the above described structure for and method of applying decorative designs to surfaces within the scope of the present invention. The foregoing description, as setting forth various constructional and operational details for purposes of understanding only, is not to be taken as limiting the scope of the present invention which is defined only by the following claim.

I claim:

1. A method of applying decorative designs through a stencil to surfaces, comprising:

placing a first layer of smooth waterproof adhesive tapes having a width less than the desired stencil width adjacent each other longitudinally to obtain a desired stencil width, each of said tapes having a non-adhesive waterproof front surface and an adhesive rear surface, said adhesive being thicker at the outside than in the middle of the rear surface;

placing a second layer of smooth waterproof adhesive tapes adjacent each other on said first layer in overlapping relationship thereto and covering the seams therein to form a laminated sheet, the adhesive rear surface of said second layer contacting the non-adhesive front surface of said first layer;

cutting a decorative design out of said sheet to form a stencil;

applying the stencil to a surface, with the adhesive rear surface of the first layer contacting said surface;

painting the stencil including the decorative design cut out portion; and removing the stencil from the surface leaving the decorative design painted thereon.

* * * * *